United States Patent [19]

Osawa et al.

[11] Patent Number: 4,800,243

[45] Date of Patent: Jan. 24, 1989

[54] CONTACTOR RUBBER

[75] Inventors: Yasuhisa Osawa, Kawaguchi; Yasuko Kimura, Tokyo, both of Japan

[73] Assignee: Fuji Rubber Co. Limited, Japan

[21] Appl. No.: 43,560

[22] PCT Filed: Aug. 14, 1986

[86] PCT No.: PCT/JP86/00419

§ 371 Date: May 8, 1987

§ 102(e) Date: May 8, 1987

[87] PCT Pub. No.: WO87/01235

PCT Pub. Date: Feb. 26, 1987

[51] Int. Cl.[4] ..... H01H 1/02

[52] U.S. Cl. ..... 200/514; 200/268; 200/269

[58] Field of Search ..... 200/268, 269, 264, 159 B, 200/5 A

[56] References Cited

U.S. PATENT DOCUMENTS 4,207,443 6/1980 Matsuura ..... 200/159 B 4,528,428 7/1985 Gotoh et al. ..... 200/159 B

FOREIGN PATENT DOCUMENTS 2576449 7/1986 France ..... 200/159 B

OTHER PUBLICATIONS

*Specifying And Using Rubber,* Sept. 1984 in Electronic Engineering, pp. 189–192.

*Primary Examiner*—Renee S. Luebke

*Attorney, Agent, or Firm*—McGlew and Tuttle

[57] ABSTRACT

A rubber structure contact connector includes a support upon which is placed an electrical contact. An insulating material, such as rubber, is applied over the contact and overlies the support and it has a portion which is formed as a raised dome-shaped resilient compressible portion or actuating key. On the interior of the dome-shaped, resilient compressible portion, there is a surface which has an oil-resistant layer thereon and a conductive portion which overlies the oil-resistant layer. The conductive portion is aligned over the electrical contact. In another embodiment, instead of the covering on the interior surface of the key which includes only an oil-resistant layer and an electrical conductive part, there is an electro-conductive part on the interior surface followed by an oil-resistant layer and another electrical conductive part.

4 Claims, 1 Drawing Sheet

CONTACTOR RUBBER

BACKGROUND OF THE INVENTION

1. Field of the Invention

The present invention relates to an elastomeric or rubber structure of with a contact for use in a switching device, such as, a key board for various electronics devices, including electronic portable computers, digital watches, word processors, personal computer, video disc arrangements, audio instruments, and the like. The rubber structure serves as an interconnector between the electrodes of a, printed circuit board, LSI-chips and the like with the contact.

2. Description of the Prior Art

Devices are known, in which the conduction part or conductor element consists of an electroconductive rubber or elastomeric portion prepared by dispersing carbon powder in a mass of electrically insulating rubber or elastomeric material. The carbon powder is bonded under vulcanisation with the electroinsulating rubber; in which the surface of an electroinsulating rubber is printed with an electrically conductive ink or the like.

BRIEF SUMMARY OF THE INVENTION

A rubber structure with a contact is employed in a manipulator key for key operation of a, switching key board or the like and is provided a key top for finger touch to effect key input. Upon such a finger touch onto the key top, fats or organic acid esters on the human finger will necessarily be transferred to the key top, which will penetrate through the material of key top and, after a prolonged period of time has been elapsed, reach to the rubber structure and deposit thereon to cover it, increasing thereby the contact resistance upon contact of the structure with a contact rubber with the pairing contact member. Also, oils and lower molecular weight siloxanes contained in the resin material of key top may separate and deposit on the conduction part, to thereby facilitate further the increase in the contact resistance and may even hinder the electric conduction in an extreme case.

By the present invention, it is contemplated to prevent deposition of insulating substances, such as, oils, lower siloxanes and fats and esters from human finger onto the conduction part or contact of the contactor rubber structure, by inserting between the conduction part and the resin body of the key top an oil-resistant layer.

Thus, the invention proposes to arrange an oil-resistant layer inserted between the conduction part and the resin body of the key top. By incorporation of such an oil-resistant insertion layer, any deposition or penetration of electroinsulating substances from the emvironment or from the human finger can be prevented, even though the key board is placed in a factory or in a cooking room etc. where the atmosphere is contaminated with oily mists.

For incorporating an oil-resistant layer, measures may be taken into consideration, in which a film of resin is interposed between the insulating resin body of the key top and the electroconductive rubber layer, in which the resin film is arranged between two electroconductive rubber layers, in which a layer of oil-resistant rubber is disposed over the electroinsulating key top body, and so on.

If the oil-resistant layer is placed between two electroconductive rubber layers, it is possible that only these electroconductive layers are molded separately and are bonded afterwards onto the contactor rubber body with an adhesive to form an integral body. This is advantageous, since the adhesion work of the electroconductive layers onto the rubber body can be effected without concern as to whether the face of the electroconductive layer is upside-down, permitting thus easier work.

DETAILED DESCRIPTION OF PREFERRED EMBODIMENTS

Figure 1:
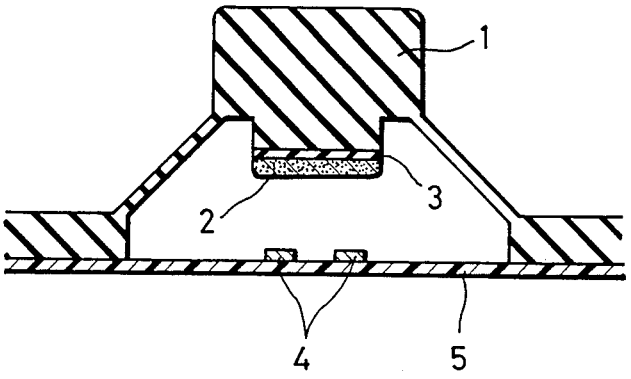
FIG. 1 shows one example of an arrangement according to the present invention in a vertical section.

In FIG. 1, a key top of a key board has on its bottom face a layer of electroconduction part 2 under an interposition of an oil-resistant layer 3. 4 is an electrode on a printed circuit board substrate 5. The key top 1 is prepared by molding an amount of insulating rubber. On the underside of the key top 1 projecting downwards, an oil-resistant layer 3 is disposed by printing or depositing an oil-resistant substance derived from a non-vulcanized silicone rubber on a portion of the key top, such as those in which a halogen or an organic compound is grafted on the principal siloxane polymer chain, or so on (such as fluorosilicone rubber, NBR, fluoride rubber, acrylic rubber, epichlorohydrin rubber etc.), and the surface of this oil-resistant layer 3 is further provided with an electroconductive layer 2 formed by printing an electroconductive ink thereon. Of course, it is possible to incorporate an oil-resistant layer by inserting it therebetween. The oil-resistant layer 3 (FIG. 1) or 13 (FIG. 2) may be of a material such as an oil-resistant layer or a synthetic resin film.

Figure 2:
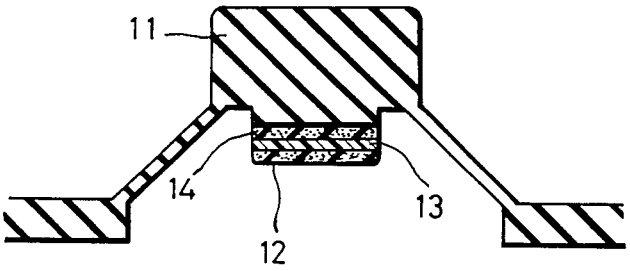
FIG. 2 is another example of the present invention shown also in a vertical section.

In FIG. 2, which illustrates another embodiment of the present invention, the bottom face of the key top body 11 is provided with an electroconductive layer 14, an oil-resistant layer 13 and a further electroconductive layer 12. The inner most electroconductive rubber layer 14, the resin film 13 and the outermost electroconductive rubber layer 12 are prepared separately each in a form of film, from which the respective sheet pieces are cut out by punching them in a predetermined shape, which are then bonded on the bottom face of the key top body 1 by an adhasive in the sequence mentioned above.

What is claimed is:

1. A rubber structure contact connector, comprising a support having an electrical contact, an insulating rubber portion overlying said contact on said support and having a raised dome-shaped resilient compressible portion with an interior face and an opposite exterior face, said opposite exterior face being formed as a key, said interior face of said compressible portion having an oil-resistant layer thereon, and a conductive portion overlying said oil-resistant layer aligned over said electrical contact.

2. A rubber structure contact connector according to claim 1, including an additional electroconductive layer applied on said interior face of said compressible portion disposed between said oil-resistant layer and said interior face of said compressible portion.

3. A rubber structure contact connector according to claim 1, wherein the oil-resistant layer consists of an oil-resistant rubber.

4. A rubber structure contact connector according to claim 1, wherein the oil-resistant layer consists of a synthetic resin film.

* * * * *